US012173463B2

(12) United States Patent
Houle

(10) Patent No.: US 12,173,463 B2
(45) Date of Patent: Dec. 24, 2024

(54) ANGLED DRIVE FOR SNOWBLOWER

(71) Applicant: IMMEUBLES MFP 1006 INC., Wickham (CA)

(72) Inventor: Pascal Houle, Wickham (CA)

(73) Assignee: IMMEUBLES MFP 1006 INC., Wickam (CA)

( * ) Notice: Subject to any disclaimer, the term of this patent is extended or adjusted under 35 U.S.C. 154(b) by 777 days.

(21) Appl. No.: 17/373,134

(22) Filed: Jul. 12, 2021

(65) Prior Publication Data

US 2022/0010513 A1 Jan. 13, 2022

Related U.S. Application Data

(60) Provisional application No. 63/050,928, filed on Jul. 13, 2020.

(51) Int. Cl.
*E01H 5/06* (2006.01)
*E01H 5/07* (2006.01)
*E01H 5/09* (2006.01)

(52) U.S. Cl.
CPC ..... *E01H 5/076* (2013.01); *E01H 5/061* (2013.01)

(58) Field of Classification Search
CPC ..... A01B 59/00; A01B 59/048; A01B 71/06; E01H 5/061; E01H 5/076; E01H 5/098
See application file for complete search history.

(56) References Cited

U.S. PATENT DOCUMENTS 5,346,018 A * 9/1994 Koster ..... A01B 59/048 37/231
2014/0075792 A1* 3/2014 Girouard ..... E01H 5/098 37/257
2014/0202047 A1* 7/2014 Kawakami ..... E01H 5/098 37/257
2014/0265239 A1* 9/2014 Foster ..... G05G 1/105 701/50

* cited by examiner

*Primary Examiner* — Thomas B Will
*Assistant Examiner* — Robert E Pezzuto
(74) *Attorney, Agent, or Firm* — Benoit & Cote Inc.; Mathieu Audet

(57) ABSTRACT

Embodiments of the invention provide a snowblower comprising a body including a pair of ground contacting members disposed at a bottom portion of the body, a blade for scraping the ground, the blade being secured at the bottom portion of the body, a snow blowing mechanism disposed in the body and an impeller housing located in the snow blowing mechanism, the impeller housing including an impeller rotation axis thereof disposed non-parallel with a horizontal ground when the snowblower is in an optimal levelled operation position, the impeller rotation axis being angled to increase a height of an impeller drive in direction of a power source.

19 Claims, 8 Drawing Sheets

ANGLED DRIVE FOR SNOWBLOWER

CROSS-REFERENCES

The present application is a nonprovisional of, and claims priority under 35 U.S.C. 119(e) to, U.S. provisional patent application No. 63/050,928, filed Jul. 13, 2020, entitled ANGLED DRIVE FOR SNOWBLOWER, which is incorporated herein by reference in its entirety. Any publication of and any patent issuing from the foregoing U.S. patent application is hereby incorporated herein by reference.

BACKGROUND OF THE INVENTION

1. Field of the Invention

This invention generally relates to an apparatus for blowing snow. The present invention more specifically relates to a snowblower including an angled drive for connecting to a snowblower power unit. The present invention also relates to other features adapted to improve the drive assembly of a snowblower.

2. Description of the Related Art

Apparatuses for removing snow come in various configurations. They come in small size for personal snowblowers and they reach significant sizes in industrial applications. Generally, snowblowers are designed to remove snow, ice, and sometimes other debris, from the ground and propel the snow and ice at a distance to clear the ground.

Snowblowers can use different mechanical configurations to perform the required task. Some snowblowers are using an endless screw in front of the apparatus to break the snow and the ice in smaller portions, in a first stage, and then use a rotatable impeller to propel the snow and the ice at a distance from the snowblower, in a second stage. Alternative snowblowers can use a single stage. Both snowblower configurations are requiring a drive portion to be actuated. The distance and the direction of the projected snow are managed with a directional nozzle. The snowblower can be powered in different ways, generally with an engine via a drive member. The engine can be part of the snowblower in some configurations. A vehicle carrying the snowblower can alternatively provide power to the snowblower in other configurations.

The rotatable impeller generally includes a series of vanes or blades sized and designed to carry snow and ice. Rotation of the blades is propelling the snow and the ice. The snow is generally pushed toward the exterior diameter of the impeller when propelled by the rotating impeller, subjected to centrifugal forces. To some extents, the impeller can be compared to a turbine that is pumping air and snow.

Nowadays, power units for powering snowblowers, generally tractors or industrial equipment including a power take off (PTO), or the like, are increasingly powerful. These powerful equipments are getting larger and are generally higher due to their size and the corresponding size of their wheels. The PTO of such equipment is therefore at an increased vertical distance from the ground. Conversely, the snowblowing mechanism, more precisely the impeller of the snowblowing mechanism, is preferably disposed low next to the ground to collect and blow as much snow as possible. In other words, the rotation axis of the PTO is higher than the rotation axis of the impeller and that difference in height has to be compensated with an angled drive shaft interconnecting the PTO to the rotating impeller. Such drive shafts are generally equipped with a pair of universal joints, or constant velocity joints, to transmit rotational power at an angle between the drive input and the drive output. This height compensation is requiring the universal joints of the drive shaft to be substantially angled, which is detrimental to the mechanical integrity of the drive shaft in addition to limit the amount of power that can be transmitted through the drive shaft.

It is therefore desirable to provide an improved snowblower over the existing art that is configured to mitigate the height difference between the rotation axis of the PTO and the rotation axis of the snowblower impeller.

It is also desirable to provide an improved snowblower designed to locate the snowblower impeller as low as possible to the ground while limiting the required angle in the drive shaft interconnecting the PTO of the power unit driving the PTO and the impeller's rotation axis over the existing art.

Other deficiencies will become apparent to one skilled in the art to which the invention pertains in view of the following summary and detailed description with its appended figures.

SUMMARY OF THE INVENTION

One aspect of the present invention is to alleviate one or more of the shortcomings of the background art by addressing one or more of the existing needs in the art.

The following presents a simplified summary of the invention in order to provide a basic understanding of some aspects of the invention. This summary is not an extensive overview of the invention. It is not intended to identify key/critical elements of the invention or to delineate the scope of the invention. Its sole purpose is to present some concepts of the invention in a simplified form as a prelude to the more detailed description that is presented later.

Therefore, the present innovation is generally described as an improved snowblower impeller configuration for mitigating a height difference between a rotation axis of a power unit power take off (hereinafter referred to as PTO) and a snowblower impeller drive and other improvements thereof as described below.

The invention is generally described as a snowblower including an impeller housing disposed at an angle, in respect with the snowblower body and a reference planar ground level, to locate a rotation axis of the impeller at an upward angle toward a power unit PTO to reduce an angle in a drive member operatively interconnecting the PTO and the impeller.

The invention is generally described as a snowblower including an impeller housing and a portion of the body of the snowblower disposed at an angle in respect with a lower portion of the snowblower body that is designed to remain substantially parallel to the ground. The impeller housing and the portion of the body that are disposed at an angle in respect to the ground are locating a rotation axis of the impeller at an upward angle toward a power unit PTO to reduce an angle in a drive member operatively interconnecting the PTO and the impeller.

The invention is generally described as a snowblower including an impeller housing and an impeller with a rotation axis thereof rotatably assembled in the impeller housing disposed at an angle in respect with a lower portion of the snowblower body that is designed to remain substantially parallel with the ground in a snow-removal configuration. A snowblower snow-directing mechanism being operatively assembled with the snowblower housing in a perpendicular direction with respect to the rotation axis of the impeller.

The invention is generally described as a snowblower including an impeller rotation axis that is not parallel with a PTO rotation axis of a power unit powering the snowblower in optimal snow removal configuration, with a lower portion of the snowblower body that is designed to position a cutting blade in an optimal cutting position substantially parallel with the ground for proper operation of the snowblower.

The invention is generally described as a snowblower including an impeller housing that is angled upwardly toward an external power source to reduce the angle managed by drive joints of an interconnecting drive shaft.

The invention is generally described as a snowblower including an impeller rotating about a rotation axis thereof that is non-parallel with the snowblower body and the ground to reduce the angle in the driveshaft interconnecting the snowblower to a tractor hence reducing the angle sustained by the driveshaft joints, or other angle management elements, of the driveshaft.

The invention is generally described as a snowblower including a body designed to be utilized at an angle to angle the impeller rotation axis in a direction of an external power unit to reduce the angle of a drive shaft operatively interconnecting the impeller and the external power unit while maintaining a levelled ground-contacting portion.

Aspects of our work, in accordance with at least one embodiment of the invention, provide an improved snowblower impeller performance over the existing art.

Additional and/or alternative features, aspects, and advantages of embodiments of the present invention will become apparent from the following description, the accompanying drawings, and the appended claims.

DESCRIPTION OF EMBODIMENT(S) OF THE INVENTION

Figure 1:
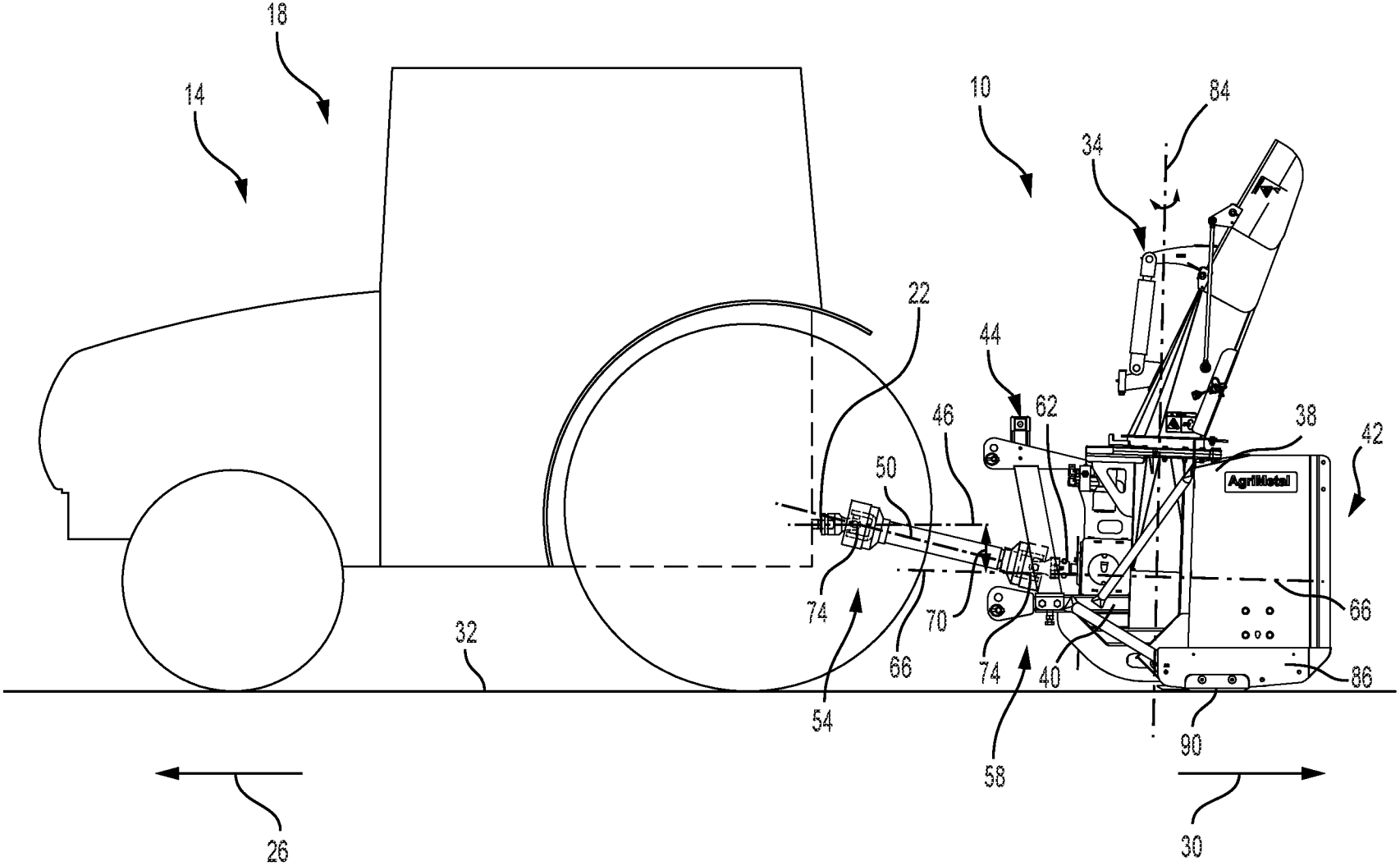
FIG. 1 is a left side elevation view of an exemplary snowblower operatively attached at the back of a vehicle, in accordance with at least one embodiment thereof.

Our work is now described with reference to the figures. In the following description, for purposes of explanation, numerous specific details are set forth in order to provide a thorough understanding of the present invention by way of embodiment(s). It may be evident, however, that the present invention may be practiced without these specific details.

As a preliminary matter, it will readily be understood by one having ordinary skill in the relevant art ("Ordinary Artisan") that the invention has broad utility and application. Furthermore, any embodiment discussed and identified as being "preferred" is considered to be part of a best mode contemplated for carrying out the invention. Other embodiments also may be discussed for additional illustrative purposes in providing a full and enabling disclosure of the invention. Furthermore, an embodiment of the invention may incorporate only one or a plurality of the aspects of the invention disclosed herein; only one or a plurality of the features disclosed herein; or combination thereof. As such, many embodiments are implicitly disclosed herein and fall within the scope of what is regarded as the invention.

Accordingly, while the invention is described herein in detail in relation to one or more embodiments, it is to be understood that this disclosure is illustrative and exemplary of the invention and is made merely for the purposes of providing a full and enabling disclosure of the invention. The detailed disclosure herein of one or more embodiments is not intended, nor is to be construed, to limit the scope of patent protection afforded the invention in any claim of a patent issuing here from, which scope is to be defined by the claims and the equivalents thereof. It is not intended that the scope of patent protection afforded the invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the invention. Accordingly, it is intended that the scope of patent protection afforded the invention is to be defined by the issued claim(s) rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

With regard solely to construction of any claim with respect to the United States, no claim element is to be interpreted under 35 U.S.C. 112(f) unless the explicit phrase "means for" or "step for" is actually used in such claim element, whereupon this statutory provision is intended to and should apply in the interpretation of such claim element. With regard to any method claim including a condition precedent step, such method requires the condition precedent to be met and the step to be performed at least once during performance of the claimed method.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers", "a picnic basket having crackers without cheese", and "a picnic basket having both cheese and crackers." When used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

Referring the drawings, one or more preferred embodiments of the invention are next described. The following description of one or more preferred embodiments is merely exemplary in nature and is in no way intended to limit the invention, its implementations, or uses. Hence, a novel manner to numerically design a cabinet adapted sustain a predetermined arc flash will be described herein after. Our work is now described with reference to the figures. In the following description, for purposes of explanation, numerous specific details are set forth in order to provide a thorough understanding of the present invention by way of embodiment(s). It may be evident, however, that the present invention may be practiced without these specific details. In other instances, when applicable, well-known structures and devices are shown in block diagram form in order to facilitate describing the present invention.

The features provided in this specification can relate to an apparatus to propel snow and ice, principles of methods of use thereof, or other machines adapted to accommodate such mechanical structure to provide such results.

Figure 2:
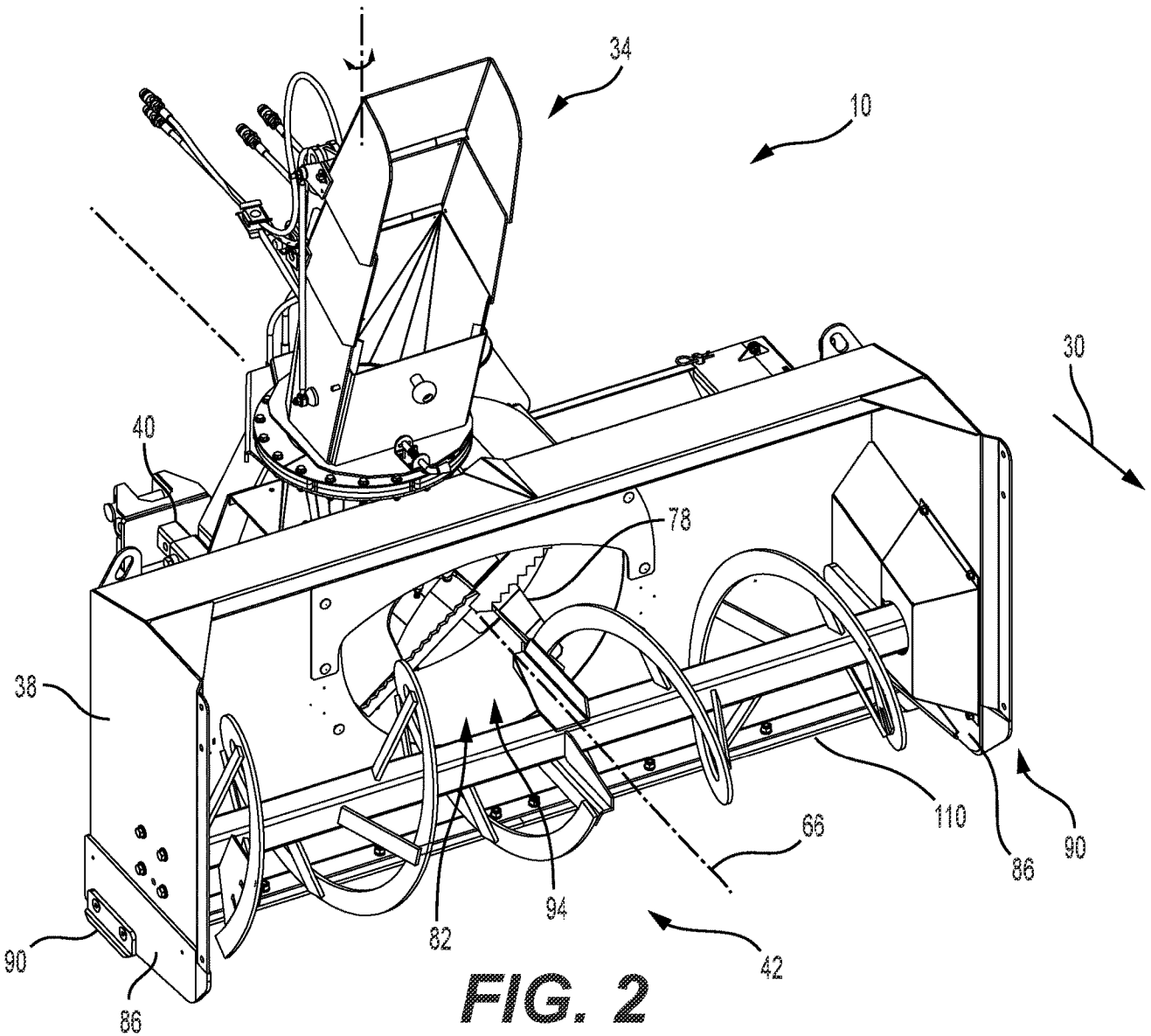
FIG. 2 is a rear-left isometric view of an exemplary snowblower, in accordance with at least one embodiment thereof.

A snowblower 10 driven and powered by a power unit 14 is illustrated in FIG. 1 and FIG. 2. The snowblower 10 is configured to clear snow and ice from the ground and propel the snow and the ice to a distance. In the present situation, the power unit 14 is a schematically illustrated tractor 18 that is powering a removable snowblower 10 powered with a power take off (PTO) 22 of the tractor 18. The tractor 18 has a front side 26 and is driven in reverse to blow snow from the ground with the snowblower 10 secured at a rear end thereof. Therefore, the snowblower 10 has a front side 30 that is opposed to the tractor's front side 26 in the illustrated configuration. The snowblower 10 could alternatively be secured to the tractor 18 in the opposite direction causing the snowblower's front side 30 to be in the same direction as the tractor's front side 26 without departing from the scope of the present invention although this configuration is not illustrated in the Figures. The snowblower 10 could also alternatively be located in front of the tractor 18 without further departing from the scope of the invention although this configuration is also not illustrated in the Figures. In the latter configuration, the front of the snowblower 10 would be in the same direction in front of the tractor 18 facing the same direction as the front of the tractor 18. The snowblower 10 could also be located in front of the tractor 18 with the snowblower's 10 front toward the rear of the tractor 18 in another unillustrated embodiment.

Still referring to FIG. 1 and FIG. 2, the PTO 22 of the tractor 18 is rotating about a PTO axis 46, which rotates a drive shaft 50 operatively connected thereto at a first end thereof 54. The drive shaft 50 is operatively connected at a second end thereof 58 to an impeller drive 62 adapted to rotate about an impeller rotation axis 66 rotatably connected to an impeller 78 (visible in FIG. 2) of the snowblower 10. There is a height difference 70 between the PTO axis 46 and the impeller rotation axis 66 that requires the drive shaft 50 to be operatively used at an angle thereof to interconnect both the PTO 22 at the level of the PTO axis 46 and the impeller 78 at the level of the impeller rotation axis 66. The drive shaft 50 includes two angular power transmission elements adapted to transmit rotational power at an angle thereof. The angular power transmission elements are embodied as universal joints 74 in the present embodiment although constant velocity joints (not illustrated) and elastomeric angular drive members allowing angular power transmission (not illustrated) are equally contemplated by the present description. The drive shaft 50 with the pair of universal joints 74 is hence allowing rotational power transmission between an input and an output that are not at the same vertical level 70. In so doing, the drive shaft 50 can rotate an impeller 78 disposed in an impeller housing 82 of proportional size preferably disposed low toward the ground 32 in the body 38 of the snowblower 10, wherein the impeller rotation axis 66 is disposed lower than the PTO axis 46.

Figure 3:
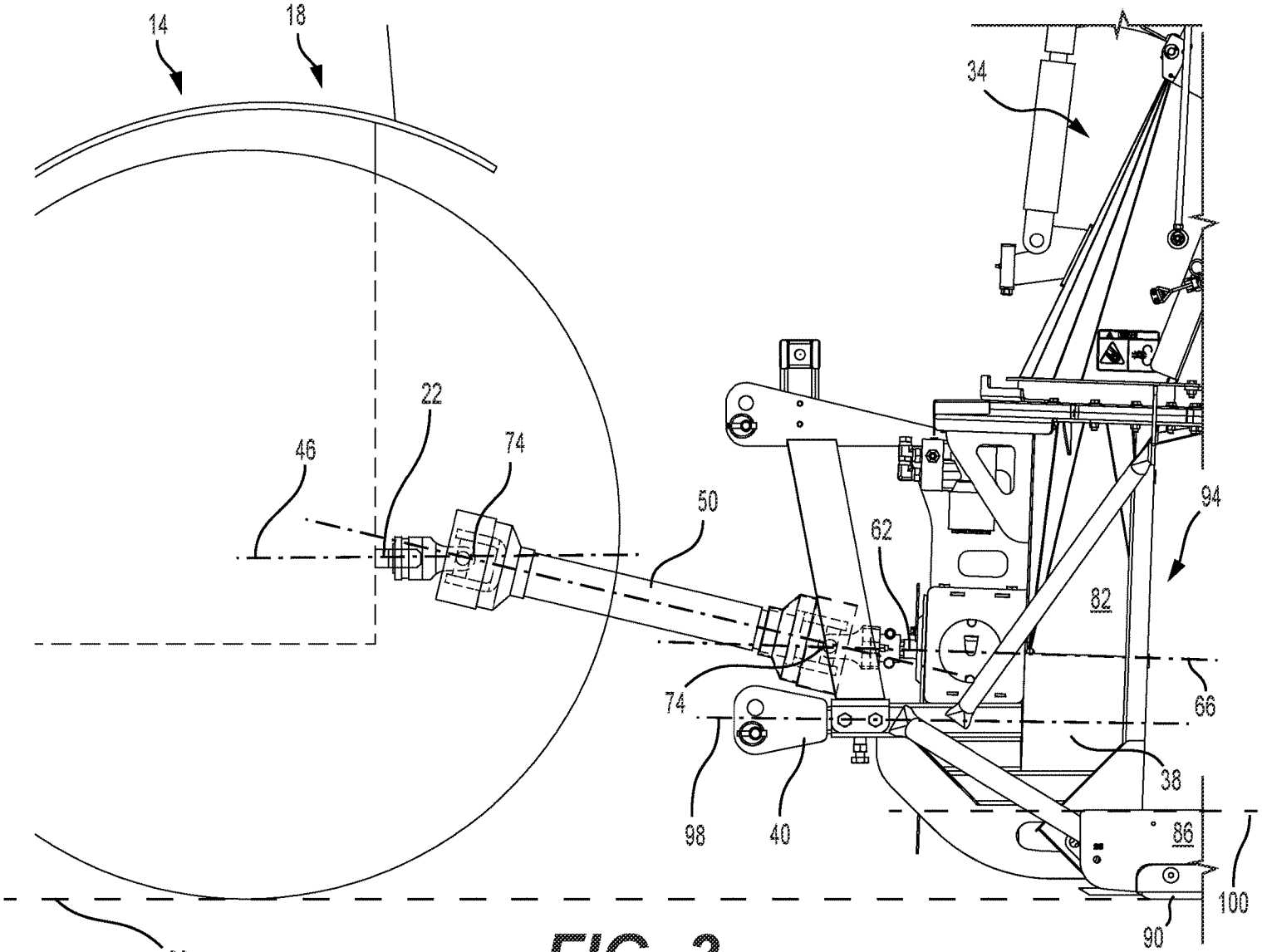
FIG. 3 is a magnified portion of the left side elevation view of the exemplary snowblower of FIG. 1, in accordance with at least one embodiment thereof.

FIG. 1 and FIG. 2 are also depicting the snowblower 10 with a snow-directing mechanism 34 capable of directing the snow propelled by the snowblower 10. The snow-directing mechanism 34 is configured to manage the direction, the distance and the height of the flow of snow propelled by the snowblower 10. The snowblower 10 is including a body 38 acting as a structural frame to which other components are operatively attached thereon and to which the snow-directing mechanism 34 is also pivotally attached. The body 38, generally made of steel sheet material, is including a snow-collecting portion 42 generally having a rectangular section pointing toward the front of the snowblower 30 in which the snow is collected before being propelled by the rotating impeller 78. The body 38 is equipped with a pair of ground-contacting members 90 adapted to level and/or set a predetermined height of the snowblower 10 from the ground 32 for optimal operation and to facilitate the movements of the snowblower 10 on the ground 32. The body 62 is including a snow blowing mechanism 94, of which the impeller housing 82 is a component, for propelling the snow collected with the snow collecting portion 42 toward the snow-directing mechanism 34 and further at a distance from the snowblower 10. The snow-directing mechanism 34 is adapted to pivot, at a lower portion thereof, in respect with the body 38 of the snowblower 10. The lower portion bearing area of the snow-directing mechanism 34 is interconnecting the snow-directing mechanism 34 with the body 38 while allowing pivotal of the snow-directing mechanism 34 in a plan generally parallel with the impeller rotation axis 66 and generally perpendicular with the direction of the snow propelled from the impeller housing 82, along an impeller housing vertical axis 84, to prevent undue restriction. FIG. 3 illustrates a magnified portion of the tractor 18 and snowblower 10 assembly illustrated in FIG. 1 for an easier appreciation of the drive components geometry.

The text that follows is going to describe a snowblower 10 in the configuration illustrated in FIG. 1 to facilitate the reading of the description. The focus directed on the snowblower 10 in the configuration illustrated in FIG. 1 is not intended to disclaim any rights associated with snowblowers 10 of different configurations even if not expressly described therein.

Figure 6:
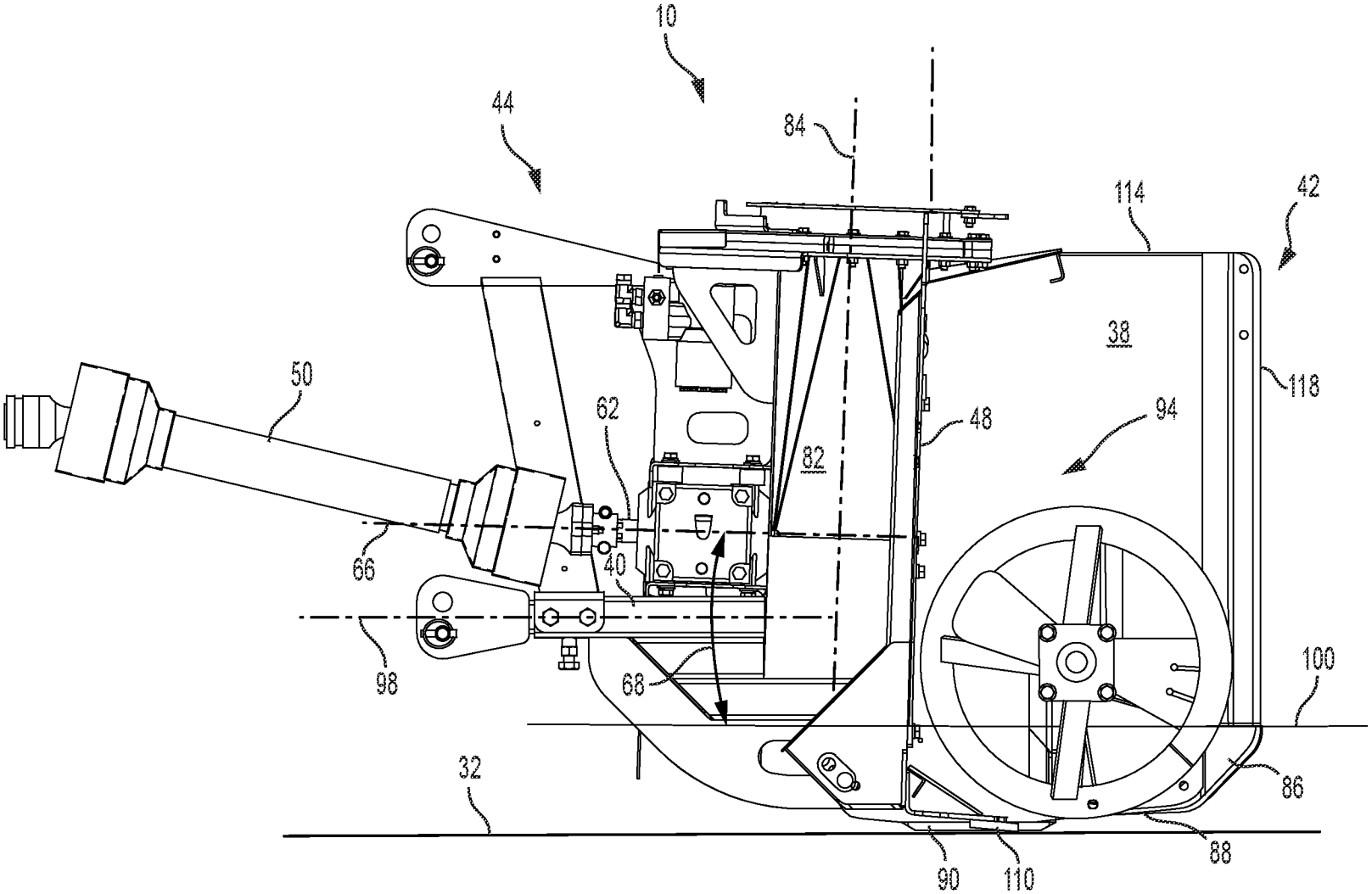
FIG. 6 is a left-side elevational section view of a portion of a snowblower, in accordance with at least one embodiment thereof.

The snowblower 10 body 38 of the embodiment illustrated in FIG. 1 throughout FIG. 6 is sized and designed to have the impeller rotation axis 66 inclined toward the front of the snowblower 10 of about an angle of between 1 degree and 10 degrees, more precisely between 1 degree and 5 degrees and optimally between 2 degrees and 3 degrees. The illustrative embodiment is using a 2-degree angle. This angle 68 is generally defined between the impeller rotation axis 66 and a virtual ground level reference line 100.

Figure 4:
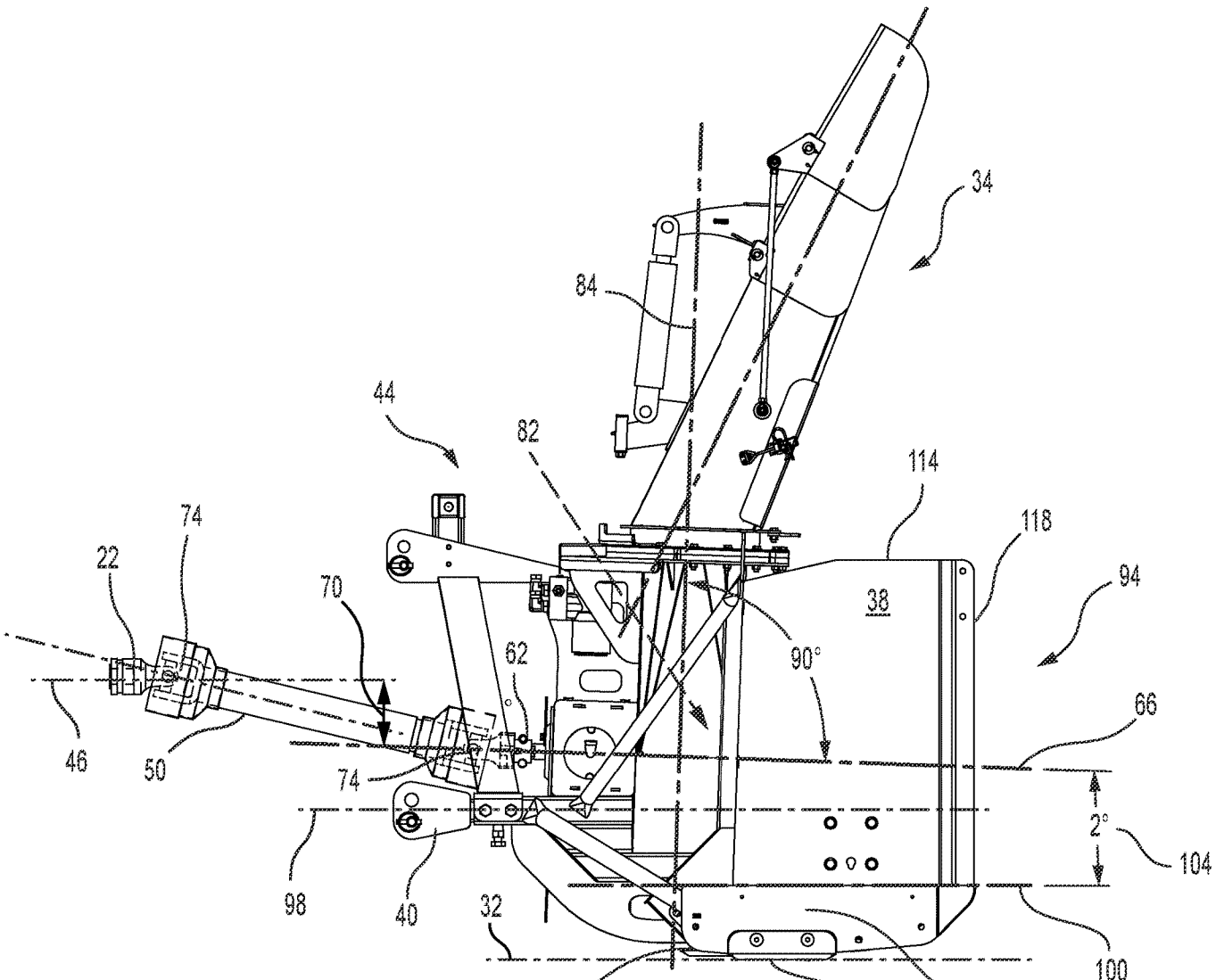
FIG. 4 is a left-side elevational view of a snowblower, in accordance with at least one embodiment thereof.
Figure 5:
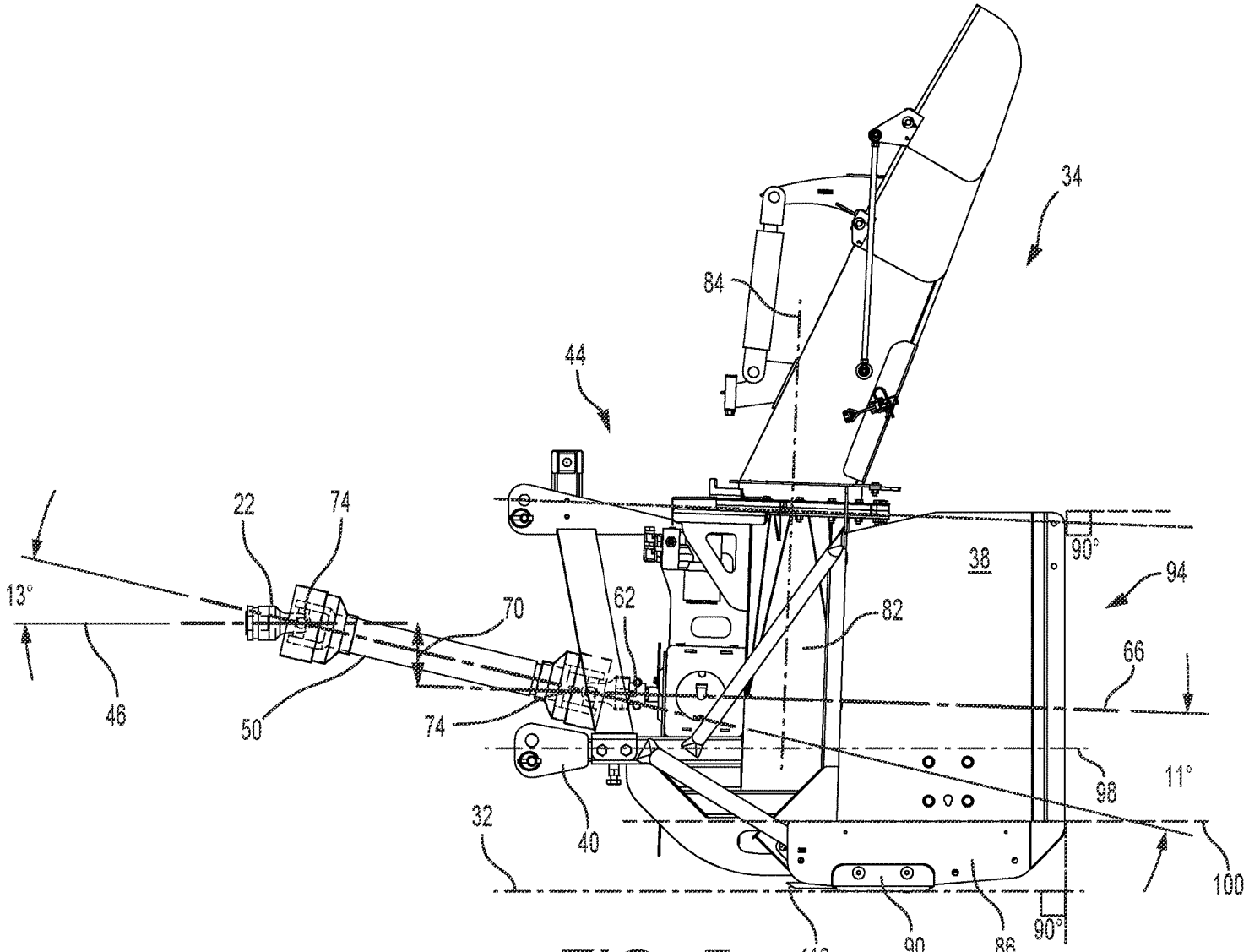
FIG. 5 is a left-side elevational view of a snowblower, in accordance with at least one embodiment thereof.

As best seen in FIG. 4, one can appreciate the top edge 114 of the body 38 is angled to be substantially parallel with the ground 32 while non-parallel with the impeller axis 66. The rear edge 118 of the body 38 is generally perpendicular to the ground 32 to keep the main rear edges 114 and 118 in orthogonal alignment with the ground 32 should the body 38 be normally leveled and not angled with respect to the ground 32. The rear edge 118 perpendicular with the ground 32 is therefore not perpendicular to the impeller axis 66. These geometrical adjustments are generally intended to provide an external shape of the snowblower 10 that is square with the ground for maintaining an aesthetic comparable with prior art snowblowers having an impeller axis parallel with the ground. Further, as best seen in FIG. 6, a back wall 48 of the snow-collecting portion 42 can be embodied parallel with respect to the impeller housing vertical axis 84. In a possible unillustrated embodiment, the back wall 48 of the snow-collecting portion 42 can be embodied non-parallel with respect to the impeller housing vertical axis 84. In the latter situation, the back wall 48 will create an increasing distance from the impeller housing 82 toward the ground. This might require a double wall between the impeller housing 82 and the back wall 48, which is contemplated in the present application.

In reference with FIG. 6, the ground level reference line 100 can be parallel with the ground 32 despite the body 38, or portions thereof, being tilted toward the front of the snowblower 10. The tilted body 38 is thus referring to a snowblower 10 designed to have at least a portion of its body 38, for example the impeller housing 82, leaning at an angle from vertical while maintaining the ground level reference line 100 generally leveled with the ground 32 for proper operation of the snowblower 10. Portions of the body 38 can remain vertically aligned in some configurations while the impeller rotation axis 66 and the portion of the body 38 surrounding the impeller 78, like the impeller housing 82, are angled in respect with the ground 32. The ground level reference line 100 can generally be represented as a horizontal reference representing the horizontality of the snowblower 10 when the snowblower 10 is leveled with the ground 32 for optimal operation. The optimal operation of the snowblower 10 is generally reflecting its design and intended mode of operation that is generally requiring the blade 110 to be optimally positioned for contacting the ground 32 and optimally cutting ice and snow from the ground 32. The ground reference line 100 is generally leveled with the ground 32 when the snowblower blade 110 is positioned with respect to the ground 32 for neutral and optimum operation of the snowblower 10. This optimal position of the blade 110 can be defined in different ways depending of the snowblower 10 design.

In some embodiments, the blade 110 can be vertically located relative to the body 38 at a predetermined distance from the ground 32 in a position adapted to closely follow the ground 32 to scrape, grade and remove snow and ice from the ground. The distance of the blade 110 in respect with the ground 32 is generally significantly small since the blade 110 is intended to remove ice and snow and also be a sacrificial element wearing out with time preventing other elements of the snowblower 10 to undesirably wear.

In a first exemplary design, the optimal position of the blade 110 is occurring when the lower arm axis 98 (or equivalent if lower arms 40 equivalents are part of a monocoque body 38 structure of the snowblower 10) is designed to be parallel with the ground 32, as illustrated in FIG. 6, when the snowblower 10 is optimally levelled with the ground 32. In the embodiment shown in FIG. 6, the lower arm axis 98 of the snowblower attachment mechanism 44 is optimally positioned parallel with the ground 32. This parallelism between the lower arms axis 98 and the ground level reference line 100 of the snowblower 10 is ensuring the pair of ground-contacting members 90 and the blade 110 are properly positioned for optimal operation for collecting snow on the ground 32, as intended in the design of the snowblower 10.

In a second exemplary design, the snow scraping (or snow grading) action of the snowy ground 32 is made by the blade 110 located at a lower portion of the body 38, as illustrated in FIG. 6, that are illustrated in a substantially similar horizontal line with the pair of ground-contacting members 90. Thus, the optimal position of the blade 110 can alternatively be defined when the pair of ground-contacting members 90 are substantially vertically positioned at a level corresponding to the height of the blade 110, as illustrated in FIG. 6. The ground level reference line 100 can thus be parallel with a virtual horizontal line drawn between a lower portion of the blade 110 and a lower portion of the ground-contacting members 90 in accordance with another embodiment when the ground-contacting members 90 are substantially levelled with the ground 32 for optimal operation of the snowblower 10. As previously described, the blade 110 and the ground-contacting members 90 can be transversally aligned across the snowblower 10 as shown in the illustrated example in FIG. 6 or be longitudinally distanced from one another in a non-illustrated embodiment without departing from the scope of the present invention. The ground-contacting members 90 can be used as a reference when the lower portion 88 of the ground-contacting member supports 86 are designed to be higher than the ground 32 in an optimal operating configuration. The ground-contacting members 90 are therefore filling the vertical gap between the ground 32 and the ground-contacting member supports 86. In the embodiment in FIG. 6, the ground-contacting member supports 86 are illustratively disposed at a distance and with an angle from the ground 32 such that the snowblower 10 can be angularly adjusted and be leveled parallel with the ground 32 for properly locating the blade 100 in vertical relation with the ground 32 for optimal performance. In accordance with embodiments of the invention, the ground level reference line 100 is generally non-parallel with the impeller rotation axis 66.

Figure 7:
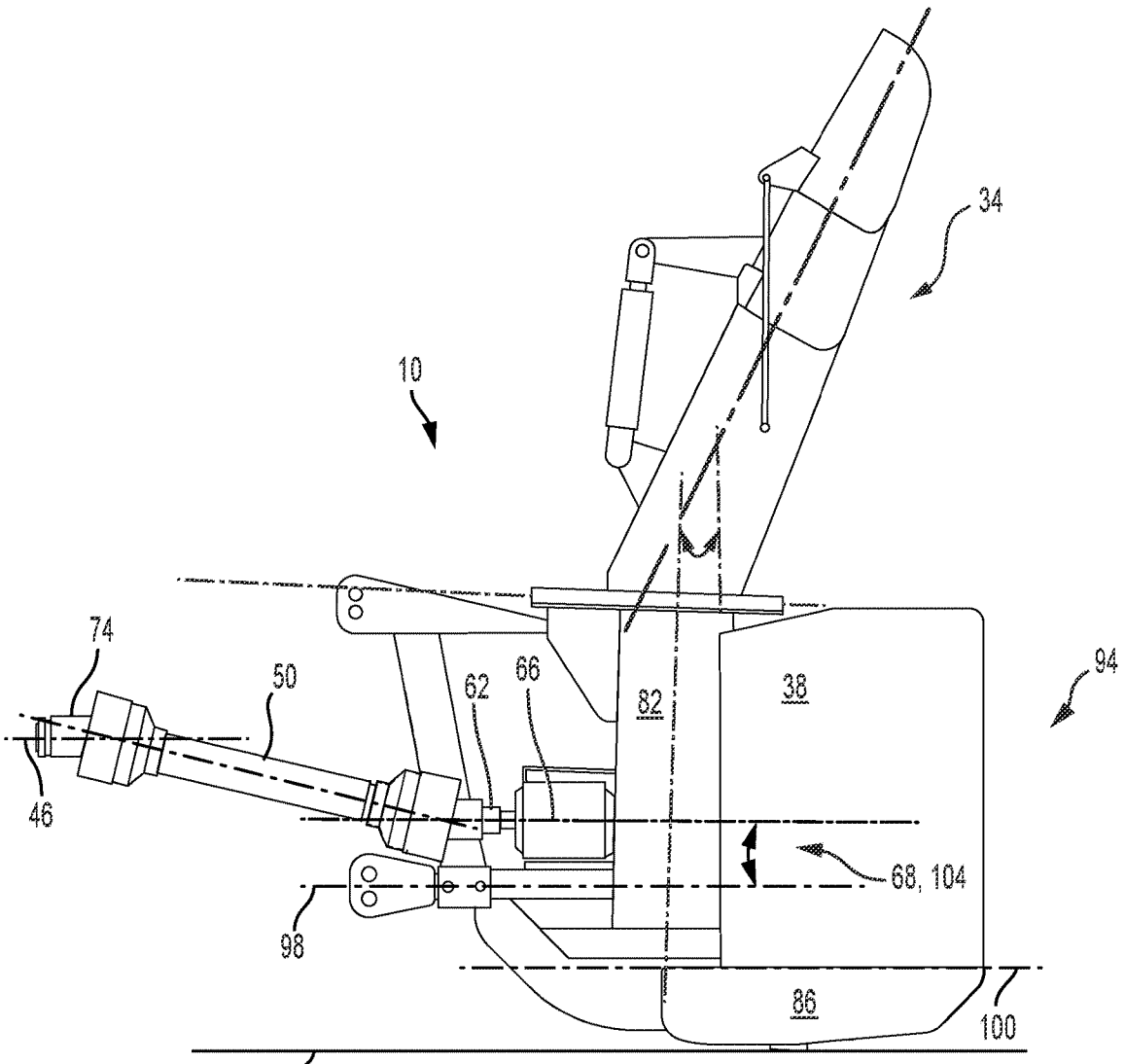
FIG. 7 is a left-side elevational view of a snowblower, in accordance with at least one embodiment thereof.
Figure 8:
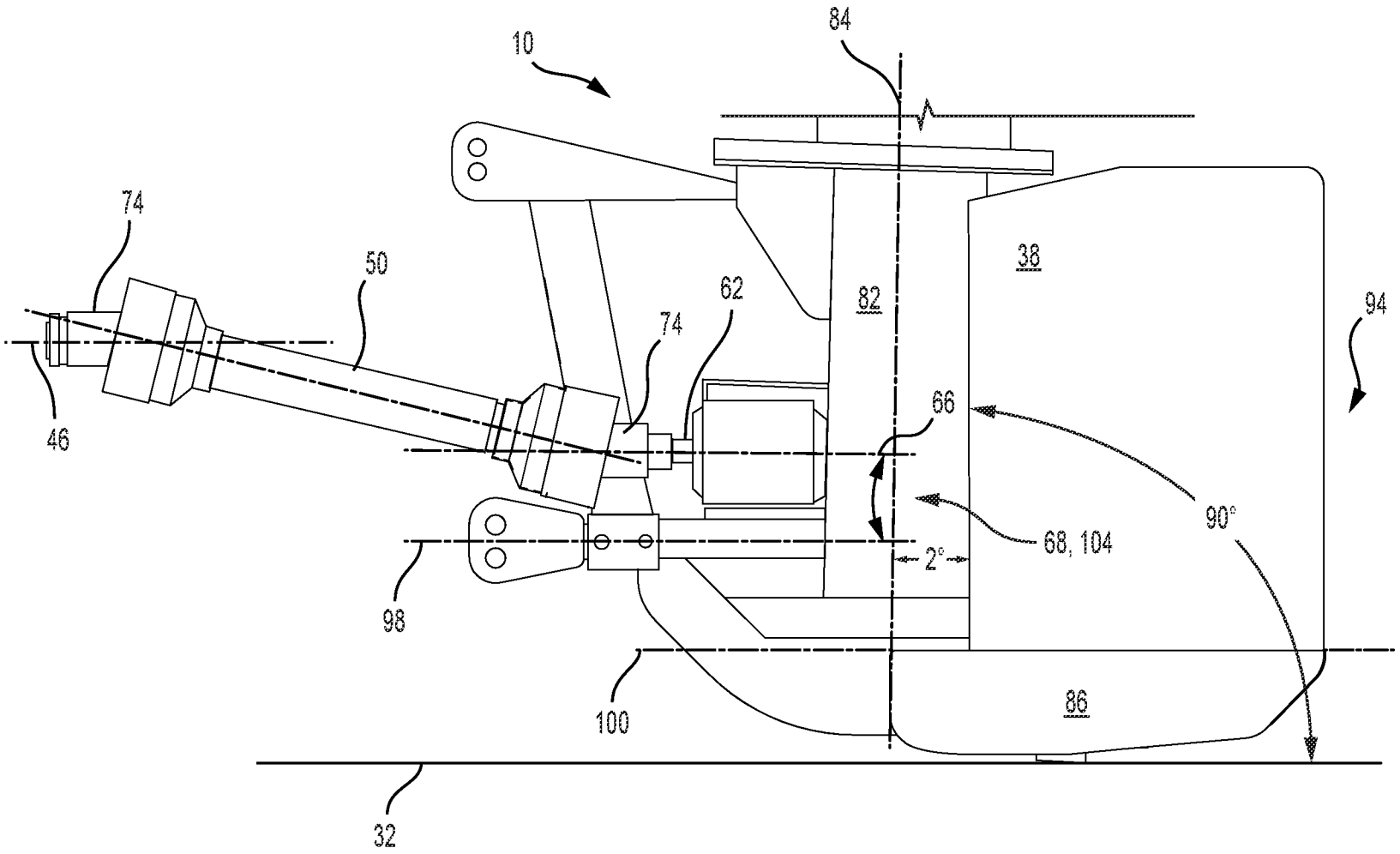
FIG. 8 is a left-side elevational view of a portion of a snowblower, in accordance with at least one embodiment thereof.

Another embodiment is schematically illustrated in FIG. 7 and FIG. 8. In this embodiment, the impeller housing 82 is tilted toward the front of the snowblower 10 in a body 38 that remains leveled with the ground 32. The impeller housing 82 is constructed and assembled such that the impeller rotation axis 66 is disposed non-parallel with the lower arms axis 98, the ground level reference line 100 and the general body 38 of the snowblower 10. The snow-directing mechanism 34 remains vertically aligned with the impeller housing 82 and the impeller rotation axis 66 is consequently not parallel with the ground level reference line 100. More precisely, the impeller housing 82 defines its orthogonal impeller rotation axis 66 that is not parallel with the ground 32 while the remaining of the body 32 is aligned in reference to the ground 32 just like a prior art snowblower 10.

The non-parallelism 104 of the impeller rotation axis 66 with the ground level reference line 100 is illustrated at 2 degrees heading higher toward the tractor 18 PTO 22. This impeller rotation axis 66 angle 68 is positioning the impeller rotation axis 66 upward toward the rear of the snowblower 10 thus reducing the power transmission angle in the universal joints 74 of the drive shaft 50. This reduction in the universal joints 74 transmission angle is mitigating the effect of the height difference 70 between the impeller drive 62 and the PTO 22.

The description and the drawings that are presented above are meant to be illustrative of the present invention. They are not meant to be limiting of the scope of the present invention. Modifications to the embodiments described may be made without departing from the present invention, the scope of which is defined by the following claims:

What is claimed is:

1. A snowblower mounted to a vehicle comprising a power unit having a PTO axis, the snowblower comprising:

a body including a pair of ground contacting members disposed at a bottom portion of the body;

a blade for scraping the ground, the blade being secured at the bottom portion of the body;

a snow blowing mechanism disposed in the body;

an impeller housing located in the snow blowing mechanism, the impeller housing including an impeller rotation axis thereof; and a drive shaft including a drive shaft axis, the drive shaft being operatively connected to the impeller housing through a first angular power transmission drive and to the power unit through a second angular power transmission drive, wherein the drive shaft axis, the PTO axis and the impeller rotation axis are non-parallel to one another, and wherein the impeller rotation axis is disposed non-parallel with a horizontal ground when the snowblower is in an optimal levelled operation position, the impeller rotation axis being angled to increase a height of an impeller drive in direction of the power unit when the snowblower is in the optimal levelled operation position.

2. The snowblower of claim 1, wherein the optimal levelled operation position is parallel with a virtual ground level reference line projecting between a lower portion of the pair of ground-contacting members and a lower portion of the blade.

3. The snowblower of claim 1, wherein the optimal levelled operation position is parallel with a ground level virtual reference line associated with the pair of ground contacting member supports.

4. The snowblower of claim 1, wherein the optimal levelled operation position is parallel with a pair of lower arms from securing a snowblower attachment mechanism, the pair of lower arms being substantially parallel with a ground reference line adapted to be parallel with the ground when the snowblower is in operation for blowing snow from the ground.

5. The snowblower of claim 1, wherein an impeller housing vertical axis is disposed at non 90-degree angle with reference to a ground level reference line associated with the 31 body.

6. The snowblower of claim 1, wherein the impeller axis is not parallel with the PTO axis of a power unit when the snowblower is in the optimal levelled operation position.

7. The snowblower of claim 1, wherein an impeller housing vertical axis is not parallel with a forward vertical edge of the body.

8. The snowblower of claim 1, wherein the impeller axis is vertically angled between about 1 degree and about 3 degrees in respect with a ground level reference line associated with the body.

9. The snowblower of claim 1, wherein the impeller axis is vertically angled between about 2 degrees in respect with a ground level reference line associated with the body.

10. The snowblower of claim 1, wherein the body further comprises a top edge, the top edge being substantially disposed at about a 90-degree angle with a rear edge of the body.

11. The snowblower of claim 1, wherein the body further includes a rear edge that is substantially perpendicular to a pair of lower arms.

12. The snowblower of claim 1, wherein the impeller drive is operatively connected to a constant velocity joint.

13. The snowblower of claim 1, wherein the body further comprises a top edge, the top edge being substantially disposed at about a non 90-degree angle with the impeller axis.

14. The snowblower of claim 1, wherein the PTO axis and the drive shaft axis have a first angle in-between, wherein the drive shaft axis and the impeller rotation axis have a second angle in-between, and wherein the first angle is larger than the second angle.

15. A snowblower and power unit assembly, the snowblower comprising:

a power unit comprising a power take off axis;

a body including a pair of ground contacting members disposed at a bottom portion of the body;

a blade for scraping the ground, the blade being secured at the bottom portion of the body;

a snow blowing mechanism disposed in the body;

an impeller housing located in the snow blowing mechanism, the impeller housing including an impeller rotation axis thereof; and a drive shaft having a drive shaft axis, the drive shaft being connected to the impeller housing through a first angular power transmission drive and to the power unit through a second angular power transmission drive, wherein the drive shaft axis, the power take off axis and the impeller rotation axis are non-parallel to one another when the snowblower is in an optimal levelled operation position, and wherein the impeller rotation axis is in an optimal levelled operation position for the impeller rotation axis to be angled to increase a height of an impeller drive in direction of the power unit when the snowblower is in the optimal levelled operation position.

16. The snowblower and power unit assembly of claim 15, wherein the impeller rotation axis is disposed non-parallel with a ground level reference line associated with the snowblower when the snowblower is in the optimal levelled operation position.

17. The snowblower and power unit assembly of claim 15, wherein the optimal levelled operation position is parallel with a virtual ground level reference line projecting between a lower portion of the pair of ground-contacting members and a lower portion of the blade.

18. The snowblower and power unit assembly of claim 15, wherein the optimal levelled operation position is parallel with a ground level virtual reference line associated with a pair of ground contacting member supports.

19. The snowblower and power unit assembly of claim 15, wherein an impeller housing vertical axis is disposed at non 90-degree angle with reference to a ground level reference line associated with the body.

* * * * *